US011339633B1

(12) United States Patent
Bull et al.

(10) Patent No.: US 11,339,633 B1
(45) Date of Patent: May 24, 2022

(54) SPLIT FLOW SUCTION MANIFOLD

(71) Applicant: Halliburton Energy Services, Inc., Houston, TX (US)

(72) Inventors: Brad Robert Bull, Duncan, OK (US); Timothy Holiman Hunter, Duncan, OK (US); Glenn Howard Weightman, Duncan, OK (US); Bruce Carl Lucas, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/122,781

(22) Filed: Dec. 15, 2020

(51) Int. Cl.

| | |
|---|---|
| ***E21B 43/12*** | (2006.01) |
| ***F04B 17/06*** | (2006.01) |
| ***E21B 34/00*** | (2006.01) |
| ***F04B 23/04*** | (2006.01) |
| ***E21B 43/26*** | (2006.01) |

(52) U.S. Cl.
CPC ..... *E21B 43/12* (2013.01); *E21B 34/00* (2013.01); *E21B 43/26* (2013.01); *E21B 43/2607* (2020.05); *F04B 17/06* (2013.01); *F04B 23/04* (2013.01)

(58) Field of Classification Search
CPC ..... E21B 43/12; E21B 43/2607; E21B 43/26; E21B 34/00; F04B 17/06; F04B 23/04
See application file for complete search history.

(56) References Cited

U.S. PATENT DOCUMENTS

| | | | | |
|---|---|---|---|---|
| 5,095,987 | A | 3/1992 | Weaver et al. | |
| 5,799,734 | A | 9/1998 | Norman et al. | |
| 7,845,413 | B2 | 12/2010 | Shampine et al. | |
| 8,336,631 | B2 | 12/2012 | Shampine et al. | |
| 8,851,186 | B2 | 10/2014 | Shampine et al. | |
| 9,016,383 | B2 | 4/2015 | Shampine et al. | |
| 9,534,604 | B2 | 1/2017 | Lopez et al. | |
| 10,174,599 | B2 | 1/2019 | Shampine et al. | |
| 2003/0117890 | A1* | 6/2003 | Dearing | E21B 21/062 366/182.2 |
| 2014/0096974 | A1* | 4/2014 | Coli | E21B 43/26 166/358 |
| 2014/0231554 | A1* | 8/2014 | Ungchusri | E21B 43/26 239/722 |
| 2015/0204173 | A1 | 7/2015 | Shampine et al. | |

(Continued)

OTHER PUBLICATIONS

Mandarich, Matthew, et al., "Split-Fluid Method Improves Fracturing Operational Efficiency," Society of Professional Engineers SPE141523, SPE Production and Operations Symposium, Mar. 2011.

*Primary Examiner* — James G Sayre

(74) *Attorney, Agent, or Firm* — John Wustenberg; Baker Botts L.L.P.

(57) ABSTRACT

The disclosure provides a manifold comprising a trailer and a piping system. The piping system is disposed on top of the trailer, wherein the piping system comprises a first set of conduits and a second set of conduits. Each of the first set of conduits and the second set of conduits comprises a first line comprising an inlet disposed at a first side of the trailer and a second line comprising an inlet disposed at the first side of the trailer, wherein the first line is disposed above the second line. There is a plurality of outlets and a plurality of valves disposed along the second line.

20 Claims, 3 Drawing Sheets

(56) References Cited

U.S. PATENT DOCUMENTS

| | | | | |
|---|---|---|---|---|
| 2016/0376864 | A1* | 12/2016 | Roesner | E21B 33/068<br>166/308.1 |
| 2017/0122060 | A1* | 5/2017 | Dille | B60P 3/2205 |
| 2017/0268306 | A1* | 9/2017 | Kajaria | B60P 3/2265 |
| 2019/0233275 | A1 | 8/2019 | Carr et al. | |
| 2020/0149380 | A1* | 5/2020 | Procita | F24F 13/00 |

* cited by examiner

SPLIT FLOW SUCTION MANIFOLD

TECHNICAL FIELD OF THE INVENTION

The present disclosure relates generally to well operations and, more particularly, to systems and methods for simultaneously treating multiple wells from a central location.

BACKGROUND

In the production of oil and gas in the field, it is often required to stimulate and treat several well locations within a designated amount of time. Stimulation and treatment processes often involve mobile equipment that is set up at a pad location and is then moved by truck from pad to pad within short time periods. To accommodate multiple wells, well treatment operations may treat more than one well at the same time. However, there is an increased likelihood of damaging equipment when pumping prepared treatment fluids.

Figure 1:
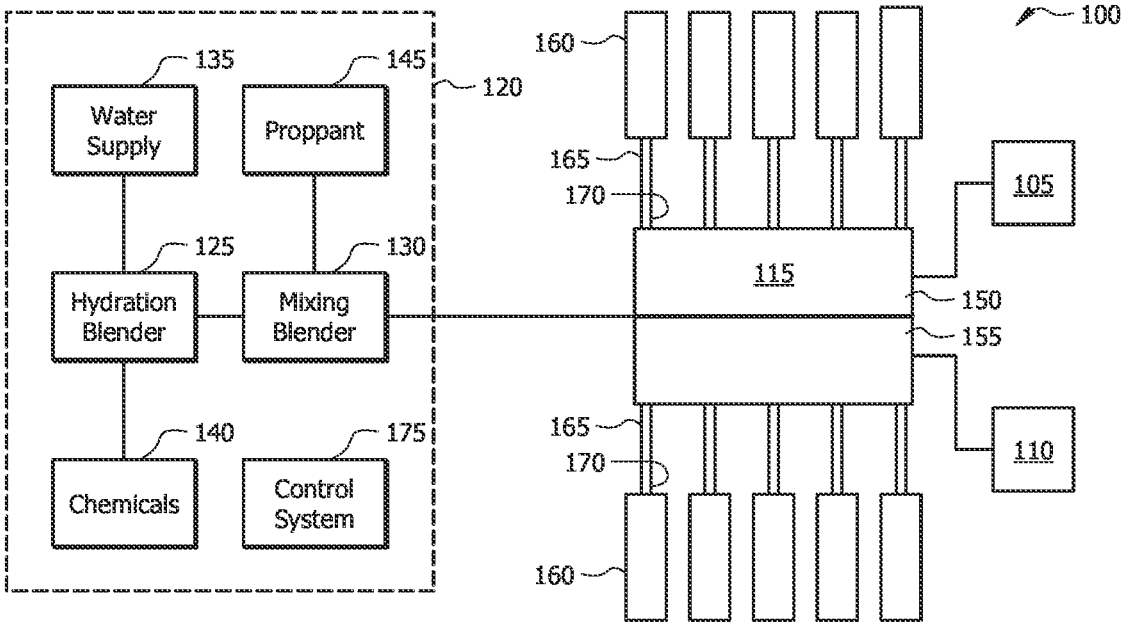
FIG. 1 is a schematic diagram of an example centralized well treatment facility, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "la" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments described below with respect to one implementation are not intended to be limiting.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples," as used herein, are intended to mean either an indirect or direct connection. Thus, if a first device couples to a second device, that connection may be through a direct connection, or through an indirect electrical connection or a shaft coupling via other devices and connections.

Simultaneous well stimulation and treatment processes from a centralized location can simplify logistics and reduce operation time and costs. In some applications, a single fracturing crew or fleet can increase their productivity by fracturing multiple wells from a centralized location without the need for additional blending equipment or personnel. However, as multiple wells are simultaneously stimulated or treated from a central location, an operator may not be able to monitor fluid flow to each well treated from the centralized location. Further, the operator may not be able to address equipment damage presented through pumping treatment fluids.

The present disclosure provides for systems and methods for an improved manifold for split flow operations. The provided systems and methods may be able provide for simultaneous fracturing and to mitigate equipment damage by reducing particle accumulation present in the deadhead of treatment fluids within a piping system.

FIG. 1 illustrates an example of a centralized well treatment facility 100 that can employ the principles of the present disclosure. Multiple wells, such as a first well 105 and a second well 110 may be treated or stimulated simultaneously using the centralized well treatment facility 100. The well treatment facility 100 may be set upon a pad from which at least the first well 105 and the second well 110 may be serviced. In some embodiments, the well treatment facility 100 may be connected to at least the first well 105 and the second well 110 via a central manifold 115. Connections within the well treatment facility 100 may be a standard piping or tubing known to one of ordinary skill in the art. The well treatment facility 100 may include a centralized location 120 that includes at least some of the components of the well treatment facility 100 and may be open, or may be at least partially enclosed with various combinations of structures including a supported fabric structure, a collapsible structure, a prefabricated structure, a retractable structure, a composite structure, a temporary building, a prefabricated wall and roof unit, a deployable structure, a modular structure, a preformed structure, or a mobile accommodation unit.

Advantageously, the well treatment facility 100 may allow for fluids for treatment, to stimulation, fracturing, or other well operations to be manufactured, formed and/or mixed at the centralized location 120 prior to being transferred to the first well 105 and the second well 110. In some embodiments, well fluids can be created by optionally mixing constituents in a hydration blender 125 before mixing the fluid in a mixing blender 130. In some embodiments, water from a water supply 135 and dry powder may be introduced into the hydration blender 125. Dry powder, such as guar may be metered into the hydration blender 125 from a storage tank via a screw conveyor. In some embodiments, various chemical additives and modifiers may be introduced into the hydration blender 125 from a chemical storage system 140.

In some embodiments, the chemical storage system 140 is connected to the hydration blender 125 and may include tanks for breakers, gel additives, crosslinkers, and liquid gel concentrate. The tanks may have level control systems such as a wireless hydrostatic pressure system and may be insulated and heated. Pressurized tanks may be used to provide positive pressure displacement to move chemicals, and some tanks may be agitated and circulated. The chemical storage system 140 may continuously meter chemicals with additive pumps, which are able to meter chemical solutions to the hydration blender 125 at specified rates as determined by the required final concentrations and the pump rates of the main treatment fluid from the hydration blender 125. In some embodiments, chemical storage tanks of the chemical storage system 140 are pressurized to drive fluid flow. The quantities and rates of chemicals added to the main fluid stream may be controlled by valve-metering control systems. In addition, chemical additives may be added to the main treatment fluid in the hydration blender 125 via aspiration. The rates that the chemical additives are aspirated into the main fluid stream may be controlled via adjustable, calibrated apertures located between the chemical storage system 140 and the hydration blender 125. In some embodiments, the components of the chemical storage system 140 are modularized allowing pumps, tanks, or blenders to be added or removed independently.

After pre-mixing in the hydration blender 125, the treatment or fracturing fluid may be further mixed in the mixing blender 130. In some embodiments, mixing can occur solely in the mixing blender 130 without any pre-mixing in the hydration blender 125. In some embodiments, the mixing blender 130 may be utilized to introduce, mix and blend proppant and chemical additives into a base fluid. Mixing can be accomplished at downhole pump rates. In some embodiments, the mixing blender 130 is configured to blend proppant and chemical additives into the base fluid without destroying the base fluid properties while still providing ample energy for the blending of proppant into a near fully hydrated fracturing fluid.

Proppant may be introduced into the mixing blender 130 from a proppant storage system 145. In some embodiments, the proppant storage system 145 may include automatic valves and a set of tanks that contain proppant. Each tank can be monitored for level, material weight, and the rate at which proppant is being consumed. This information may be transmitted to a controller or control area. Each tank is capable of being filled pneumatically and may be emptied through a calibrated gravity discharge. Tanks may be added to or removed from the proppant storage system 145 as needed. Empty storage tanks may be replenished as full or partially full tanks are being used, allowing for continuous operation. The tanks may be arranged around a calibrated v-belt conveyor. In addition, a resin-coated proppant may be used by the addition of a mechanical proppant coating system.

In some embodiments, the mixed or manufactured fluid from the mixing blender 130 may be pumped simultaneously to the first well 105 and the second well 110 via the central manifold 115. In some embodiments, the central manifold 115 may be isolated into a first isolated manifold path 150 directed to the first well 105 and a second isolated manifold path 155 directed to the second well 110. The first isolated manifold path 150 and the second isolated manifold path 155 may be integrated in a single, central manifold 115, which may be referred to as a "missile." The use of the central manifold 115 may allow for multiple wells to be fractured or treated simultaneously.

Treatment or fracturing fluid may be transferred, transported, and/or pressurized within the first isolated manifold path 150 and the second isolated manifold path 155 via an array of pumps 160. The array of pumps 160 may be fluidly connected to the first isolated manifold path 150 via suction lines 165 and discharge lines 170. A separate array of pumps 160 may be fluidly connected to the second isolated manifold path 155 via suction lines 165 and discharge lines 170. The pumps 160 within the arrays may be electric, gas, diesel, or natural gas powered. In some embodiments, the pumps 160 may be modularized for ease of configuration. In some embodiments, the output and pressure of the pumps 160 may be adjusted in response to sensor data, such as data received from a flow meter.

As treatment or fracturing fluid flows from the centralized location 120 to the first well 105 and the second well 110 via the central manifold 115, a flow meter may be in fluid communication with the first isolated manifold path 150 and/or with the second isolated manifold path 155 to provide an operator and/or a control system 175 with flow rate and total flow information. The flow meter may provide flow information about each flow to the first well 105 and the second well 110 for precise measurement and regulation. Flow measurements for the first well 105 and the second well 110 may allow for enhanced control of treatment or fracturing of both the first well 105 and the second well 110 while allowing for the benefits of a centralized well treatment facility 100 as described herein. Without limitations, the flow meter can be any suitable type of flow meter, including, but not limited to an orifice plate, Pitot tube, averaging Pitot tube, flume, weir, turbine, target, positive displacement, rotameter, vortex, Coriolis, ultrasonic, magnetic, wedge, v-cone, flow nozzle, and/or Venturi type flow meters. The flow meter can be utilized to measure mass and/or volumetric flow rates of the fluid. Information from the flow meter can be transmitted to a display and/or to the control system 175.

In some embodiments, the operations of the chemical storage system 140, hydration blender 125, proppant storage system 145, mixing blender 130, manifold 115, and/or pumps 160 are controlled, coordinated, and monitored by the central control system 175. The central control system 175 may utilize sensor data as well as operating parameters from the chemical storage system 140, hydration blender 125, proppant storage system 145, mixing blender 130, manifold 115, and pumps 160 to identify operation of the well treatment facility 100. In some embodiments, the control system 175 may be utilized to adjust the output of the pumps 160 by utilizing flow data in light of fluid flow targets for the first well 105 and/or the second well 110. In some embodiments, fluid flow to the first well 105 and/or the second well 110 may be exclusively controlled by adjusting the output of the pumps 160. Further, information from a flow meter can be utilized to control desired fluid properties such as density, rate, viscosity, etc. Flow information can also be utilized to identify dynamic or steady state bottlenecks within the well treatment facility 100. The central control system 175 may also be used to monitor equipment health and status.

In one or more embodiments, the central control system 175 may be disposed about any suitable location in the well treatment facility 100. In alternate embodiments, central control system 175 may be located remotely from the well treatment facility 100. The central control system 175 may be directly or indirectly coupled to any one or more components of the well treatment facility 100.

Figure 2:
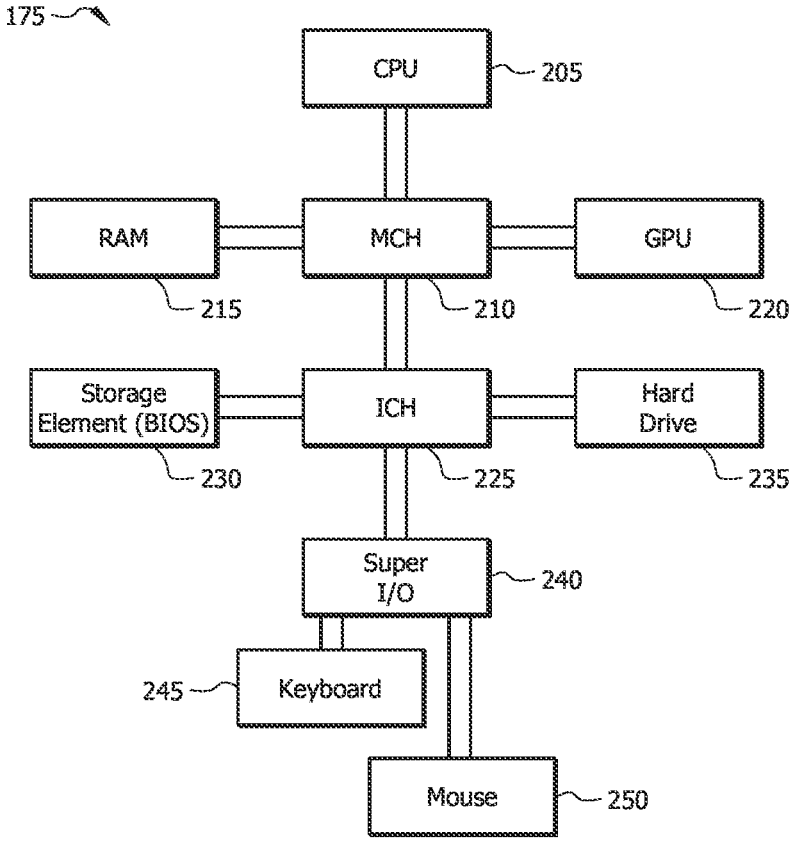
FIG. 2 is a diagram illustrating an example central control system, according to aspects of the present disclosure.

FIG. 2 is a diagram illustrating an example central control system 175, according to aspects of the present disclosure. A processor or central processing unit (CPU) 205 of the central control system 175 is communicatively coupled to a memory controller hub or north bridge 210. The processor 205 may include, for example a microprocessor, microcontroller, digital signal processor (DSP), application specific integrated circuit (ASIC), or any other digital or analog circuitry configured to interpret and/or execute program instructions and/or process data. Processor 205 may be configured to interpret and/or execute program instructions or other data retrieved and stored in any memory such as memory 215 or hard drive 235. Program instructions or other data may constitute portions of a software or application for carrying out one or more methods described herein. Memory 215 may include read-only memory (ROM), random access memory (RAM), solid state memory, or disk-based memory. Each memory module may include any system, device or apparatus configured to retain program instructions and/or data for a period of time (e.g., computer-readable non-transitory media). For example, instructions from a software or application may be retrieved and stored in memory 215 for execution by processor 205.

Modifications, additions, or omissions may be made to FIG. 2 without departing from the scope of the present disclosure. For example, FIG. 2 shows a particular configuration of components of central control system 175. However, any suitable configurations of components may be used. For example, components of central control system 175 may be implemented either as physical or logical components. Furthermore, in some embodiments, functionality associated with components of central control system 175 may be implemented in special purpose circuits or components. In other embodiments, functionality associated with components of central control system 175 may be implemented in configurable general-purpose circuit or components. For example, components of central control system 175 may be implemented by configured computer program instructions.

Memory controller hub (MCH) 210 may include a memory controller for directing information to or from various system memory components within the central control system 175, such as memory 215, storage element 230, and hard drive 235. The memory controller hub 210 may be coupled to memory 215 and a graphics processing unit (GPU) 220. Memory controller hub 210 may also be coupled to an I/O controller hub (ICH) or south bridge 225. I/O controller hub 225 is coupled to storage elements of the central control system 175, including a storage element 230, which may comprise a flash ROM that includes a basic input/output system (BIOS) of the computer system. I/O controller hub 225 is also coupled to the hard drive 235 of the central control system 175. I/O controller hub 225 may also be coupled to a Super I/O chip 240, which is itself coupled to several of the I/O ports of the computer system, including keyboard 245 and mouse 250.

In certain embodiments, the central control system 175 may comprise at least a processor and a memory device coupled to the processor that contains a set of instructions that when executed cause the processor to perform certain actions. In any embodiment, the central control system 175 may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The central control system 175 may include random access memory (RAM), one or more processing resources such as a central processing unit (CPU) or hardware or software control logic, read only memory (ROM), and/or other types of nonvolatile memory. Additional components of the central control system 175 may include one or more disk drives, one or more network ports for communication with external devices as well as various input and output (I/O) devices, such as a keyboard, a mouse, and a video display. The central control system 175 may also include one or more buses operable to transmit communications between the various hardware components.

Figure 3:
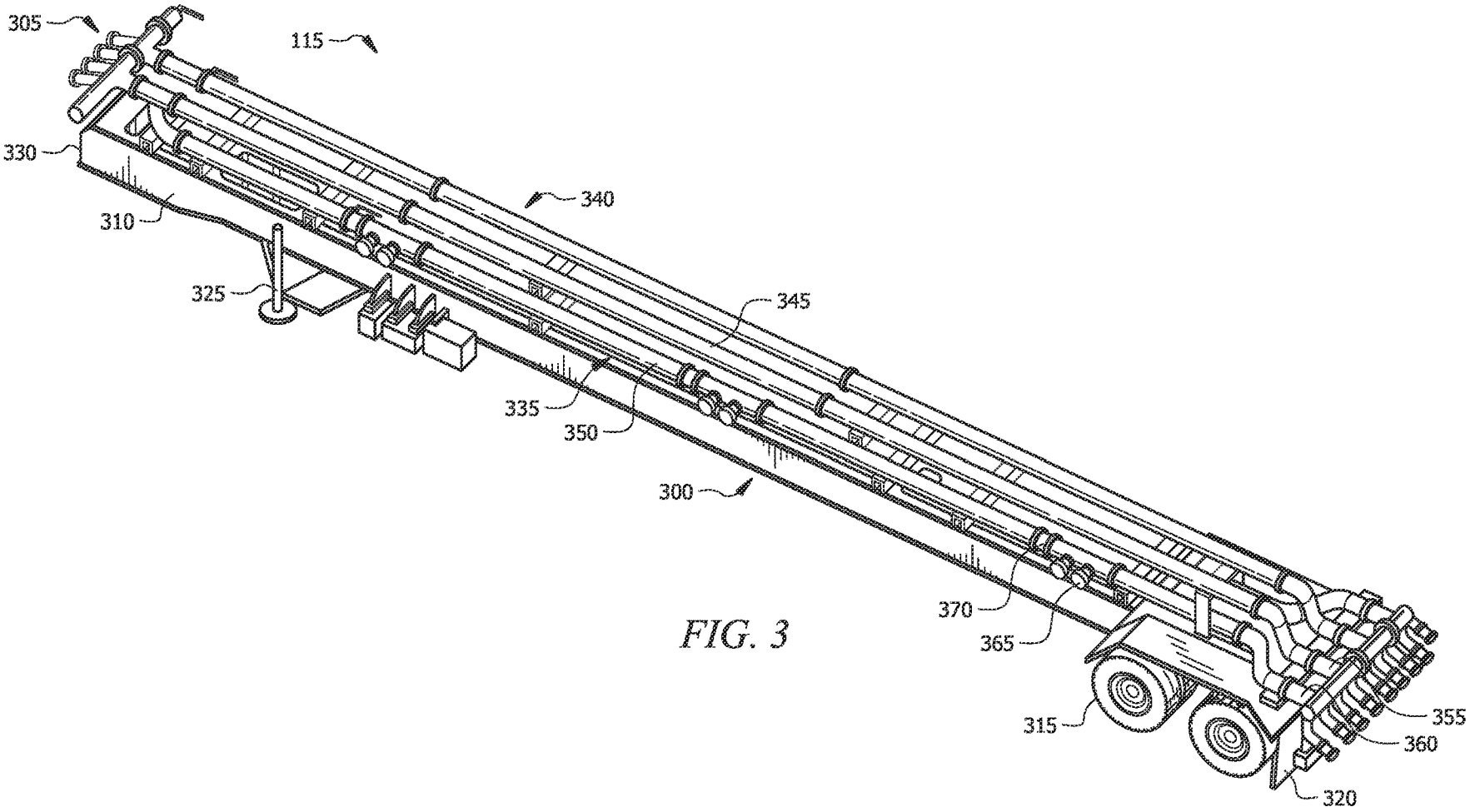
FIG. 3 is a diagram illustrating an example manifold, according to aspects of the present disclosure.
Figure 4:
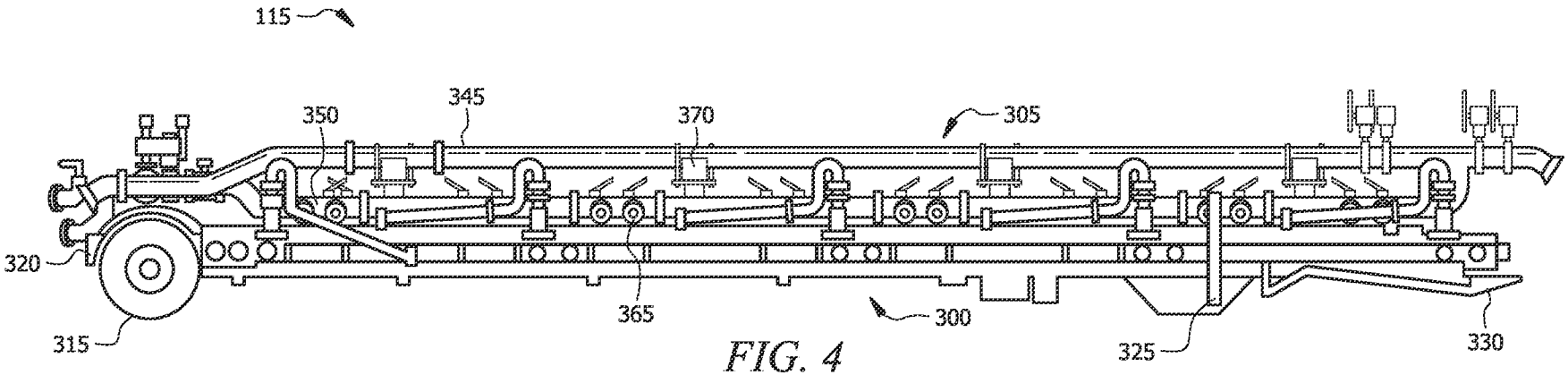
FIG. 4 is a diagram illustrating an example manifold, according to aspects of the present disclosure.
Figure 5:
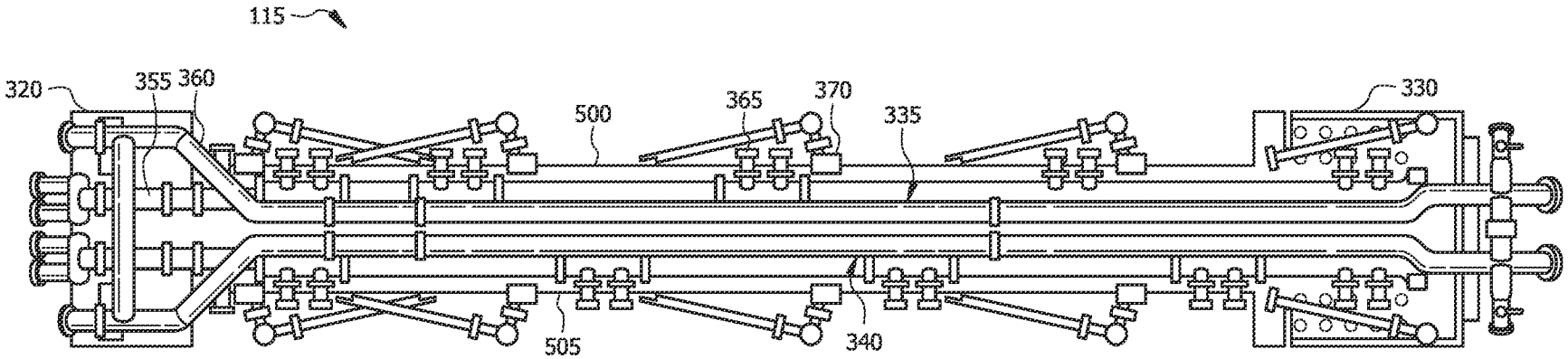
FIG. 5 is a diagram illustrating an example manifold, according to one or more aspects of the present disclosure.

FIGS. 3-5 illustrates an example of the manifold 115. FIG. 3 illustrates an isometric view of the manifold 115. FIG. 4 illustrates a side view of the manifold 115. FIG. 5 illustrates a top view of the manifold 115. As illustrated, the manifold 115 may comprise a trailer 300 and a piping system 305. In embodiments, the trailer 300 may be configured to transport and support the piping system 305 and other suitable equipment of the manifold 115. The trailer 300 may comprise any suitable size, height, shape, and any combinations thereof. In embodiments, the trailer 300 may generally comprise a chassis 310 with a rectangular cross-sectional shape. Further, the trailer 300 may comprise any suitable materials, such as metals, nonmetals, polymers, composites, and any combinations thereof. The chassis 310 may comprise one or more sets of wheels 315 disposed at a first end 320 of the trailer 300 to provide for a means of conveying the trailer from one location to another. There may further be a set of hydraulic supports 325 disposed near a second end 330 of the chassis 310 opposite to the first end 320. In one or more embodiments, the second end 330 of the chassis 310 may be attached to a vehicle (not shown) to be transported. Once the vehicle has transported to a designated location, an operator may detach the chassis 310 from the vehicle and/or may actuate the set of hydraulic supports 325 to physically support the chassis 310 near the second end 330.

As illustrated, the piping system 305 may be disposed on top of the trailer 300. The piping system 305 may be configured to facilitate a low-pressure flow of one or more fluids from the centralized location 120 (referring to FIG. 1) to the arrays of pumps 160 (referring to FIG. 1). The piping system 305 may comprise of a first set of conduits 335 and a second set of conduits 340. In one or more embodiments, the first set of conduits 335 may be fluidly isolated from the second set of conduits 340. The first set of conduits 335 may be disposed about a first side (for example, first side 500) of the trailer 300, and the second set of conduits 340 may be disposed about a second side (for example, second side 505) of the trailer 300 (i.e., about the width of the trailer 300) (as best seen on FIG. 5). In one or more embodiments, the first set of conduits 335 and the second set of conduits 340 may be disposed parallel to the length of the trailer 300.

Both the first set of conduits 335 and the second set of conduits 340 may comprise a first line 345 and a second line 350. The first line 345 of each of the first set of conduits 335 and the second set of conduits 340 may be disposed above each respective second line 350. In one or more embodiments, each first line 345 may vertically align with each second line 350. In alternate embodiments, each first line 345 may be offset from each second line 350, wherein the first line 345 is disposed closer to or further from a center of the trailer 300. In one or more embodiments, the inner diameter of each of the first lines 345 and each of the second lines 350 may be from about ½ inches (1.27 cm) to about 2 inches (5.08 cm), from about 2 inches (5.08 cm) to about 5 inches (12.7 cm), and from about 5 inches (12.7 cm) to about 12 inches (30.48 cm). Without limitations, the inner diameter of each of the first lines 345 and each of the second lines 350 may be about 8 inches (20.32 cm).

In one or more embodiments, an inlet 355 of each of the first lines 345 may be disposed at the first end 320 of the trailer 300. Further, an inlet 360 of each of the second lines 350 may also be disposed at the first end 320 of the trailer 300. The inlets 355, 360 may be configured to provide fluid communication from the centralized location 120 (referring to FIG. 1) to the manifold 115. As illustrated, there may be a plurality of outlets 365 disposed along the second lines 350, wherein each of the plurality of outlets 365 may be configured to provide fluid communication from the manifold to the arrays of pumps 160 (referring to FIG. 1), wherein the arrays of pumps 160 may increase the flow rate and/or pressure of one or more fluids which may return to the manifold 115 for further operations. Without limitations, each one of the plurality of outlets 365 may comprise dual connections to be coupled to the arrays of pumps 160. As illustrated, each of the first lines 345 may be coupled to each respective second line 350, thereby providing fluid communication between the two, wherein the plurality of outlets 365 may be utilized by one or more fluids flowing through either the first line 345 or the second line 350. The first lines 345 may be coupled to the second lines 350 at or near the second end 330 of the trailer 300.

In one or more embodiments, there may be a plurality of valves 370 disposed along each of the second lines 350 associated with each of the plurality of outlets 365. Each of the plurality of valves 370 may be disposed near each of the plurality of outlets 365 that is associated with that specific valve 370. As illustrated, with reference to the inlets 360 of the second lines 350, each one of the plurality of valves 370 may be disposed adjacent to and downstream of each one of the plurality of outlets 365. The plurality of valves 370 may be configured to switch between allowing the flow of one or more fluids from either the first lines 345 or the second lines 350 to flow out of the plurality of outlets 365. Any suitable valve may be used as the plurality of valves 370. Without limitations, a butterfly valve may be used as each of the plurality of valves.

With reference to FIGS. 1-5, a method of operating the manifold 115 may be described. In one or more embodiments, flowing one or more fluids through the arrays of pumps 160 may increase the likelihood of equipment damage if the one or more fluids are already mixed and prepared for injection rather than flowing clean water. In embodiments, the manifold 115 may inject clean water and other materials into a wellbore, wherein they are mixed as they are injected downhole rather than being prepared at the surface (for example, at centralized location 120). With regards to the present disclosure, the manifold 115 may be configured for split-flow, simultaneous fracturing operations that can provide for pumping one or more fluids clean water, treatment fluids prepared at the centralized location 120, and combinations thereof.

During operations, the first set of conduits 335 may be configured to provide for a predetermined number of pumping units of one of the arrays of pumps 160 to receive clean water and for a remaining number of pumping units of that one of the arrays of pumps 160 to receive treatment fluids that were prepared at the centralized location 120. Further, the second set of conduits 340 may also be configured to provide for a predetermined number of pumping units of a separate one of the arrays of pumps 160 to receive clean water and for a remaining number of pumping units of that one of the arrays of pumps 160 to receive treatment fluids that were prepared at the centralized location 120. In one or more embodiments, the number of pumping units to receive clean water from the first set of conduits 335 may be the same as the number of pumping units to receive clean water from the second set of conduits 340. In other embodiments, the number of pumping units to receive clean water from the first set of conduits 335 may be different from that from the second set of conduits 340.

Before introducing one or more fluids to flow into the inlets 355, 360, one of the plurality of valves 370 disposed in the first set of conduits 335 and one of the plurality of valves 370 disposed in the second set of conduits 340 may be closed. In embodiments, the same one of the plurality of valves 370 that is mirrored in each of the first set of conduits 335 and the second set of conduits 340 may be closed. Alternatively, different ones of the plurality of valves 370 that are disposed at a different position along the length of the second lines 350 may be closed. In one or more embodiments, an operator may manually actuate the plurality of valves 370 to close, the control system 175 may actuate the plurality of valves 370 to close, and combinations thereof. Further, the operator and/or the control system 175 may actuate the well treatment facility 100 to introduce one or more fluids into the inlets 355, 360.

In one or more embodiments, the one or more fluids introduced into the inlets 355 may comprise of clean water, and the one or more fluids introduced into the inlets 360 may comprise of prepared treatment fluids. As the one or more fluids are introduced into the inlets 355, 360, the one or more fluids may flow through the first lines 345 and the second lines 350. The one or more fluids flowing through the second lines 350 may be discharged out of the plurality of outlets 365 until the one or more fluids encounters the one of the plurality of valves 370 that is closed. The one of the plurality of outlets 365 that is immediately upstream of that one of the plurality of valves 370 that is closed may be the last outlet 365 configured to allow for the outflow of the one or more fluids from that second line 350.

As the plurality of outlets 365 and the plurality of valves 370 are disposed along the second lines 350, the one or more fluids introduced into the inlets 355 may flow through the first lines 345 and circulate back through the respective second lines 350. The one or more to fluids flowing through the first lines 345 may be discharged out of the plurality of outlets 365 until the one or more fluids encounters the one of the plurality of valves 370 that is closed. The one of the plurality of outlets 365 that is immediately upstream of that one of the plurality of valves 370 that is closed may be the last outlet 365 configured to allow for the outflow of the one or more fluids from that first line 345 (with reference from the inlet 355 of that first line 345).

As illustrated, the distance between the one of the plurality of valves 370 that is closed and the one of the plurality of outlets 365 that is immediately upstream of that one of the plurality of valves 370 is greater than the distance between the one of the plurality of valves 370 that is closed and the one of the plurality of outlets 365 that is immediately downstream of that one of the plurality of valves 370. Without limitations, the distance between the one of the plurality of valves 370 that is closed and the one of the plurality of outlets 365 that is immediately upstream of that one of the plurality of valves 370 may be from about 1 foot to about 5 feet, from about 5 feet to about 10 feet, or from about 10 feet to about 15 feet. In one or more embodiments, the distance may be about 12 feet. Without limitations, the distance between the one of the plurality of valves 370 that is closed and the one of the plurality of outlets 365 that is immediately downstream of that one of the plurality of valves 370 may be from about 1 inch to about 5 inches, from about 5 inches to about 10 inches, or from about 10 inches to about 15 inches. In one or more embodiments, the distance may be about 12 inches.

Each of those distances may be proportional to the deadhead of the one or more fluids flowing through the first line 345 and the second line 350, respectively. For example, the distance between the one of the plurality of valves 370 that is closed and the one of the plurality of outlets 365 that is immediately upstream of that one of the plurality of valves 370 is related to the deadhead of the one or more fluids of the first line 345, and the distance between the one of the plurality of valves 370 that is closed and the one of the plurality of outlets 365 that is immediately downstream of that one of the plurality of valves 370 is related to the deadhead of the one or more fluids of the second line 350. This configuration may provide for a reduction in particle accumulation from the deadhead of the one or more fluids in the second line 350. For example, a large deadhead produced on the side of a given valve 370 downstream from the inlet 360 may effectively get plugged off with sand and/or other solids that have accumulated. This may entirely plug the line or cause a significant slug of sand to be pushed into the pumps 160 when the valves 370 are changed, thereby causing equipment damage.

In one or more embodiments, the operator and/or the control system 175 may actuate the one of the plurality of valves 370 that is closed to open and a different one of the plurality of valves 370 to close. This may change which of and/or the number of pumping units of one of the arrays of pumps 160 to receive clean water and for the remaining number of pumping units of that one of the arrays of pumps 160 to receive treatment fluids that were prepared at the centralized location 120. This configuration may further provide for mitigation of equipment failure by providing a method that rebalances the number of pumping units receiving clean water or prepared treatment fluids.

An embodiment of the present disclosure is a manifold comprising: a trailer; and a piping system, wherein the piping system is disposed on top of the trailer, wherein the piping system comprises a first set of conduits and a second set of conduits, wherein each of the first set of conduits and the second set of conduits comprises: a first line comprising an inlet disposed at a first side of the trailer; a second line comprising an inlet disposed at the first side of the trailer, wherein the first line is disposed above the second line; a plurality of outlets disposed along the second line; and a plurality of valves disposed along the second line.

In one or more embodiments described in the preceding paragraph, wherein the inner diameter of both the first line and the second line is 8 inches. In one or more embodiments described above, with reference to the inlet of the second line, wherein the distance between each one of the plurality of outlets and one of the valves disposed downstream and adjacent to each one of the plurality of outlets is 12 inches. In one or more embodiments described above, with reference to the inlet of the second line, wherein the distance between each one of the plurality of outlets and one of the valves disposed upstream and adjacent to each one of the plurality of outlets is 12 feet. In one or more embodiments described above, wherein each one of the plurality of valves is a butterfly valve. In one or more embodiments described above, wherein the first line is coupled to the second line at a second end of the trailer, wherein the first line is in fluid communication with the second line. In one or more embodiments described above, wherein the first set of conduits is disposed at a first side of the trailer, wherein the second set of conduits is disposed at a second side of the trailer.

Another embodiment of the present disclosure is a method of operating a manifold, comprising: introducing one or more fluids into an inlet of a first line disposed at a first end of the manifold; introducing one or more fluids into an inlet of a second line disposed at the first end of the manifold, wherein the first line is coupled to the second line at a second end of the manifold, wherein the first line is in fluid communication with the second line; monitoring a deadhead at one of a plurality of valve disposed along the second line that is closed; actuating the one of the plurality of valves that is closed to an open position; and actuating another one of the plurality of valves that is open to a closed position.

In one or more embodiments described in the preceding paragraph, wherein the one or more fluids introduced into the first line is clean water. In one or more embodiments described above, wherein the one or more fluids introduced into the second line is treatment fluid. In one or more embodiments described above, wherein an information handling system is configured to actuate the plurality of valves.

A further embodiment of the present disclosure is a well treatment facility, comprising: an array of pumps; a manifold coupled to the array of pumps, comprising: a trailer; and a piping system, wherein the piping system is disposed on top of the trailer, wherein the piping system comprises a first set of conduits and a second set of conduits, wherein each of the first set of conduits and the second set of conduits comprises: a first line comprising an inlet disposed at a first side of the trailer; a second line comprising an inlet disposed at the first side of the trailer, wherein the first line is disposed above the second line; a plurality of outlets disposed along the second line; and a plurality of valves disposed along the second line; and an information handling system configured to monitor and actuate the piping system.

In one or more embodiments described in the preceding paragraph, wherein the inner diameter of both the first line and the second line is 8 inches. In one or more embodiments described above, with reference to the inlet of the second line, wherein the distance between each one of the plurality of outlets and one of the valves disposed downstream and adjacent to each one of the plurality of outlets is 12 inches. In one or more embodiments described above, with reference to the inlet of the second line, wherein the distance between each one of the plurality of outlets and one of the valves disposed upstream and adjacent to each one of the plurality of outlets is 12 feet. In one or more embodiments described above, wherein each one of the plurality of valves is a butterfly valve. In one or more embodiments described above, wherein the first line is coupled to the second line at a second end of the trailer, wherein the first line is in fluid communication with the second line. In one or more embodiments described above, wherein the first set of conduits is disposed at a first side of the trailer, wherein the second set of conduits is disposed at a second side of the trailer. In one or more embodiments described above, further comprising a first well and a second well, wherein the manifold is coupled to both the first well and the second well. In one or more embodiments described above, wherein the information handling system is configured to actuate the plurality of valves to open and close.

Unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A manifold, comprising:

a trailer; and a piping system configured to facilitate low-pressure flow, wherein the piping system is disposed on top of the trailer, wherein the piping system comprises a first set of conduits and a second set of conduits, wherein each of the first set of conduits and the second set of conduits comprises:

a first line comprising an inlet disposed at a first end of the trailer;

a second line comprising an inlet disposed at the first end of the trailer, wherein the first line is directly coupled to the second line at a location downstream from the first end of the trailer, wherein the first line is in fluid communication with the second line;

a plurality of outlets disposed along the second line; and a plurality of valves disposed along the second line.

2. The manifold of claim 1, wherein the inner diameter of both the first line and the second line is 8 inches.

3. The manifold of claim 1, with reference to the inlet of the second line, wherein the distance between each one of the plurality of outlets and one of the valves disposed downstream and adjacent to each one of the plurality of outlets is 12 inches.

4. The manifold of claim 1, with reference to the inlet of the second line, wherein the distance between each one of the plurality of outlets and one of the valves disposed upstream and adjacent to each one of the plurality of outlets is 12 feet.

5. The manifold of claim 1, wherein each one of the plurality of valves is a butterfly valve.

6. The manifold of claim 1, wherein the first set of conduits is disposed at a first side of the trailer, wherein the second set of conduits is disposed at a second side of the trailer.

7. A method of operating a manifold for low-pressure flow, comprising:

introducing one or more fluids into an inlet of a first line disposed at a first end of the manifold;

introducing one or more fluids into an inlet of a second line disposed at the first end of the manifold, wherein the first line is directly coupled to the second line at a location downstream from the first end of the manifold, wherein the first line is in fluid communication with the second line;

monitoring a deadhead at one of a plurality of valve disposed along the second line that is closed;

actuating the one of the plurality of valves that is closed to an open position; and actuating another one of the plurality of valves that is open to a closed position.

8. The method of claim 7, wherein the one or more fluids introduced into the first line is clean water.

9. The method of claim 7, wherein the one or more fluids introduced into the second line is treatment fluid.

10. The method of claim 7, wherein an information handling system is configured to actuate the plurality of valves.

11. A well treatment facility, comprising:

an array of pumps;

a manifold coupled to the array of pumps, comprising:

a trailer; and a piping system configured to facilitate low-pressure flow, wherein the piping system is disposed on top of the trailer, wherein the piping system comprises a first set of conduits and a second set of conduits, wherein each of the first set of conduits and the second set of conduits comprises:

a first line comprising an inlet disposed at a first end of the trailer;

a second line comprising an inlet disposed at the first end of the trailer, wherein the first line is directly coupled to the second line at a location downstream from the first end of the trailer, wherein the first line is in fluid communication with the second line;

a plurality of outlets disposed along the second line; and a plurality of valves disposed along the second line; and an information handling system configured to monitor and actuate the piping system.

12. The well treatment facility of claim 11, wherein the inner diameter of both the first line and the second line is 8 inches.

13. The well treatment facility of claim 11, with reference to the inlet of the second line, wherein the distance between each one of the plurality of outlets and one of the valves disposed downstream and adjacent to each one of the plurality of outlets is 12 inches.

14. The well treatment facility of claim 11, with reference to the inlet of the second line, wherein the distance between each one of the plurality of outlets and one of the valves disposed upstream and adjacent to each one of the plurality of outlets is 12 feet.

15. The well treatment facility of claim 11, wherein each one of the plurality of valves is a butterfly valve.

16. The well treatment facility of claim 11, wherein the first set of conduits is disposed at a first side of the trailer, wherein the second set of conduits is disposed at a second side of the trailer.

17. The well treatment facility of claim 11, further comprising a first well and a second well, wherein the manifold is coupled to both the first well and the second well.

18. The well treatment facility of claim 11, wherein the information handling system is configured to actuate the plurality of valves to open and close.

19. The method of claim 7, wherein the one or more fluids introduced into the first line is directed to flow into at least a portion of the second line.

20. The method of claim 7, wherein a distance between the one of the plurality of valves that is closed and the one of the plurality of outlets that is immediately upstream of that one of the plurality of valves is related to the deadhead of the one or more fluids introduced into the first line, wherein a distance between the one of the plurality of valves that is closed and the one of the plurality of outlets that is immediately downstream of that one of the plurality of valves is related to the deadhead of the one or more fluids introduced into the second line.

* * * * *